US012339033B2

(12) United States Patent
Finlaw et al.

(10) Patent No.: US 12,339,033 B2
(45) Date of Patent: Jun. 24, 2025

(54) DEHUMIDIFICATION CONTAINER

(71) Applicant: Mazarine, Inc., Panama City Beach, FL (US)

(72) Inventors: Jamin A. Finlaw, Panama City Beach, FL (US); Levi D. Sirmon, Defuniak Springs, FL (US)

( * ) Notice: Subject to any disclaimer, the term of this patent is extended or adjusted under 35 U.S.C. 154(b) by 721 days.

(21) Appl. No.: 17/525,408

(22) Filed: Nov. 12, 2021

(65) Prior Publication Data

US 2022/0154950 A1 May 19, 2022

Related U.S. Application Data

(60) Provisional application No. 63/113,435, filed on Nov. 13, 2020.

(51) Int. Cl.

| | |
|---|---|
| ***F24F 3/14*** | (2006.01) |
| ***B65D 81/26*** | (2006.01) |
| *F24F 110/22* | (2018.01) |

(52) U.S. Cl.

CPC ..... *F24F 3/14* (2013.01); *B65D 81/263* (2013.01); *F24F 2003/144* (2013.01); *F24F 2110/22* (2018.01)

(58) Field of Classification Search

None

See application file for complete search history.

*Primary Examiner* — Jason Lau

(57) ABSTRACT

Storage containers include a body with an interior space and a lid, connected at an edge to the body. A dehumidifier is in the interior space, configured to dehumidify air within the interior space. An actuator, mounted between the body and the lid, is configured to lift the lid when an arm of the actuator extends. Actuator control circuitry is configured to extend the arm of the actuator responsive to a received signal.

10 Claims, 5 Drawing Sheets

DEHUMIDIFICATION CONTAINER

FIELD OF THE DISCLOSURE

The subject matter of the present disclosure refers generally to storage containers, and, more particularly, to containers that are designed for high-humidity environments.

BACKGROUND

Humidity is one of the biggest dangers to items that are placed in storage. As moisture builds up within a storage area, pests may become attracted to the storage area and damage the items within. Further, mold and mildew can start to form on items in as little as 7-9 days if the relative humidity is greater than 85%. This may cause the materials to rot and decay over time, ruining the items placed in the storage area. Storage of material in coastal environments, such as at docks and marinas, is particularly plagued by high humidity due to the higher humidity of the environment, and the warm temperatures in addition to the high relative humidity of the air promotes even quicker growth of mold and mildew. In locations that are exposed to salt water, storage is further complicated by the presence of the salt, which can be highly corrosive to metals, particularly in humid conditions.

Accordingly, there is a need in the art for a system that can be used in highly corrosive and humid environments that removes humidity from a storage area.

SUMMARY

A system designed for storing materials in a high humidity environment is provided. The system is designed to remove humidity from a storage area so that items are not damaged by said humidity over time. In one aspect, the system removes humidity from the air within a cavity by sucking humidified air through an internal channel of the lid and distributing the humidified air to a dehumidifier where it is dehumidified. In another aspect, the system creates a seal between the lid and the body that prevents water from entering the cavity and damaging materials. Generally, the system is a storage container designed to protect materials within its cavity from water damage. Implementations of the present principles may include storage containers that may be used in humid and/or corrosive environments to protect their contents from damage. Such storage boxes may be used, for example, to provide convenient storage on a dock, improving the appearance of the dock by removing clutter. The storage boxes may also provide security for the owner's belongings, using the electric actuator to hold the lid closed when not in use. In some locations, for example where a marina's rules require on-dock storage, a storage box may be used to comply with such rules.

The system generally comprises a body, lid, and dehumidifier contained within the body. Intake fans are designed to pull humidified air from the cavity of the body and push said humidified air through internal channels and conduits that guide said air to the dehumidifier. The body and lid may furthermore be secured to one another, using powerful actuators to hold a lid of the container against a body of the container, and the body may be secured to a surface using anchors. Additionally, an emergency release switch positioned within the container may prevent users from being trapped inside the cavity. The dehumidifier may be powered by shore power, by integrated solar panels, and/or by any other appropriate source of electric power. The lid of a storage box may be powered or unpowered in its opening and closing. In the case of powered lids, automatic opening and closing functionality may be provided using an electric actuator that may be controlled wirelessly, or by a control on the storage box itself.

The foregoing summary has outlined some features of the system and method of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purpose of the system and method disclosed herein. Those skilled in the pertinent art should also realize that such equivalent designs or modifications do not depart from the scope of the system and method of the present disclosure. For instance, although the present embodiments are described with particular focus on use in a dock, marina, or similar shore or marine environment, one with skill in the art will understand that the system may be used to provide storage in any appropriate environment without departing from the inventive subject matter described herein.

DESCRIPTION OF THE DRAWINGS

These and other features, aspects, and advantages of the present disclosure will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
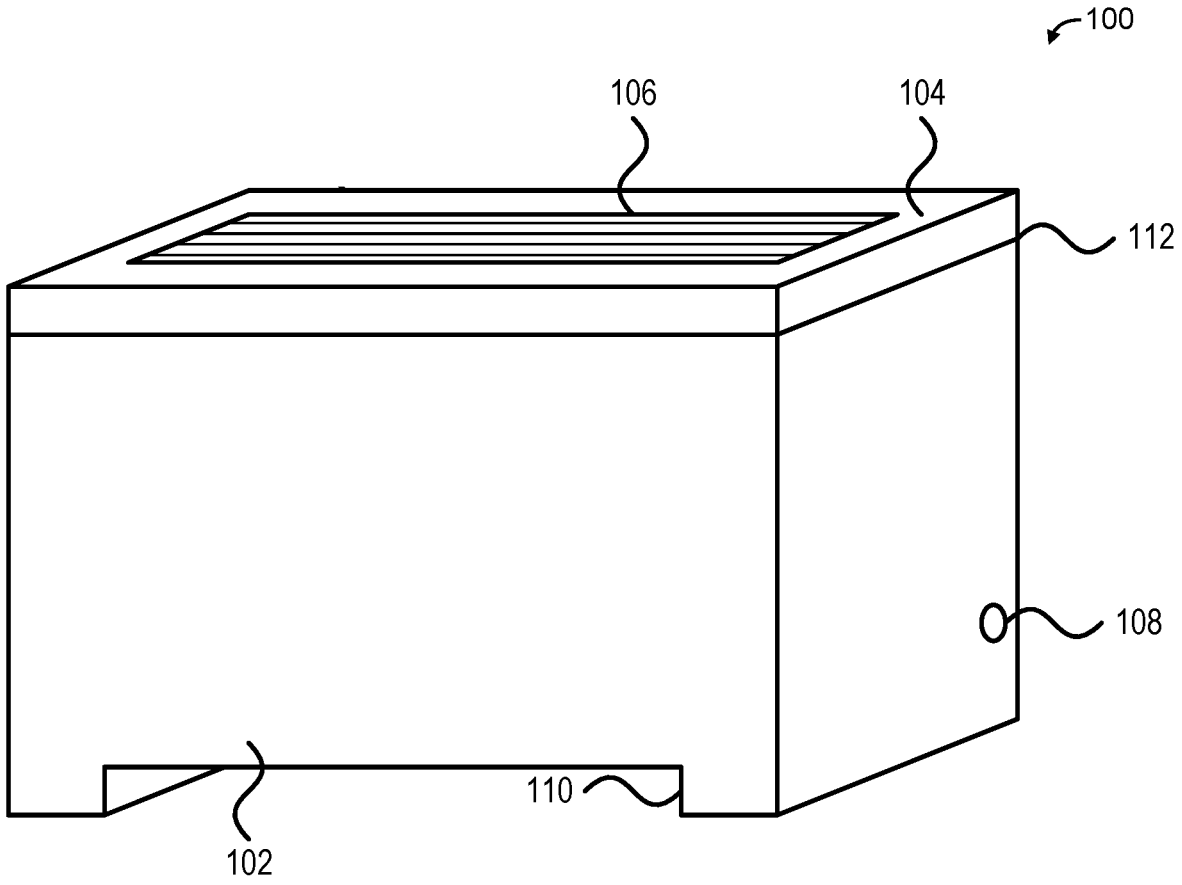
FIG. 1 is a diagram of a secure, self-powered, climate-controlled storage container embodying features consistent with the principles of the present disclosure.
Figure 2:
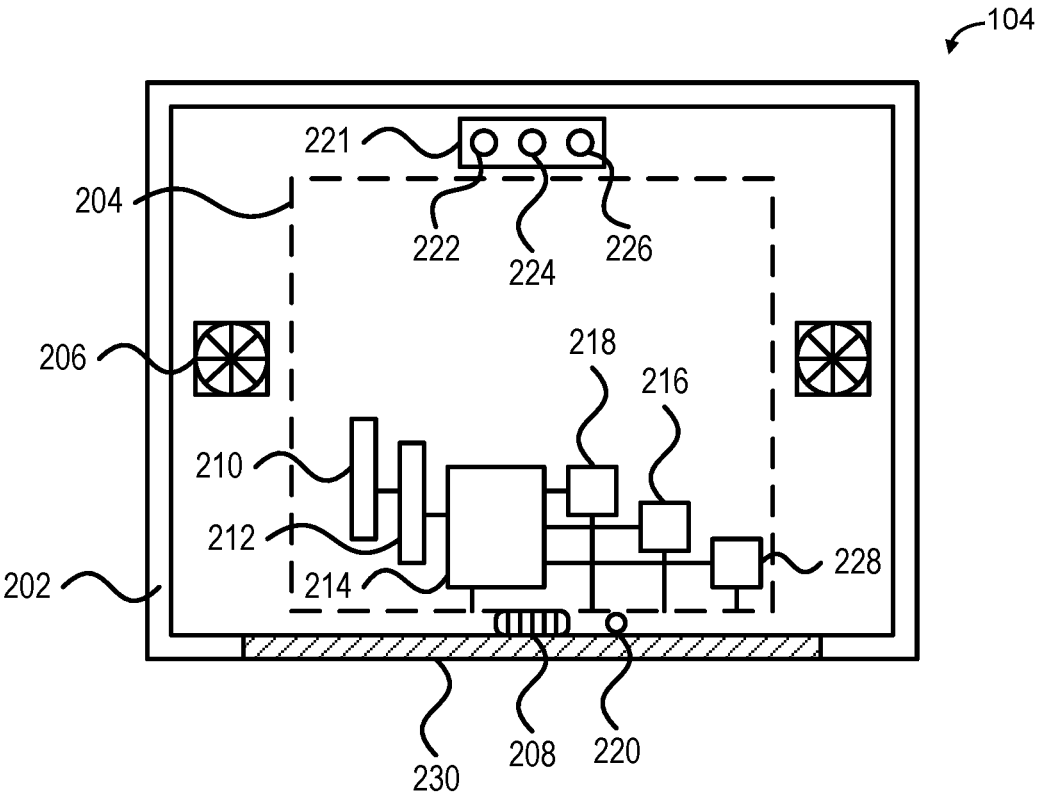
FIG. 2 is a diagram of a bottom-up view of a lid of a storage container embodying features consistent with the principles of the present disclosure.
Figure 3:
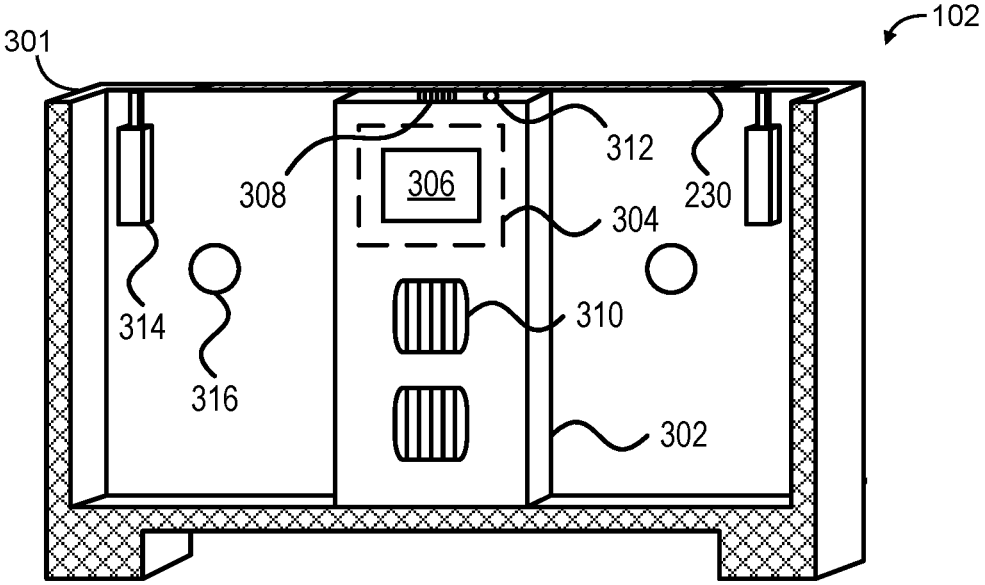
FIG. 3 is a cut-away diagram of a body of a storage container, showing a climate control conduit, embodying features consistent with the principles of the present disclosure.
Figure 4:
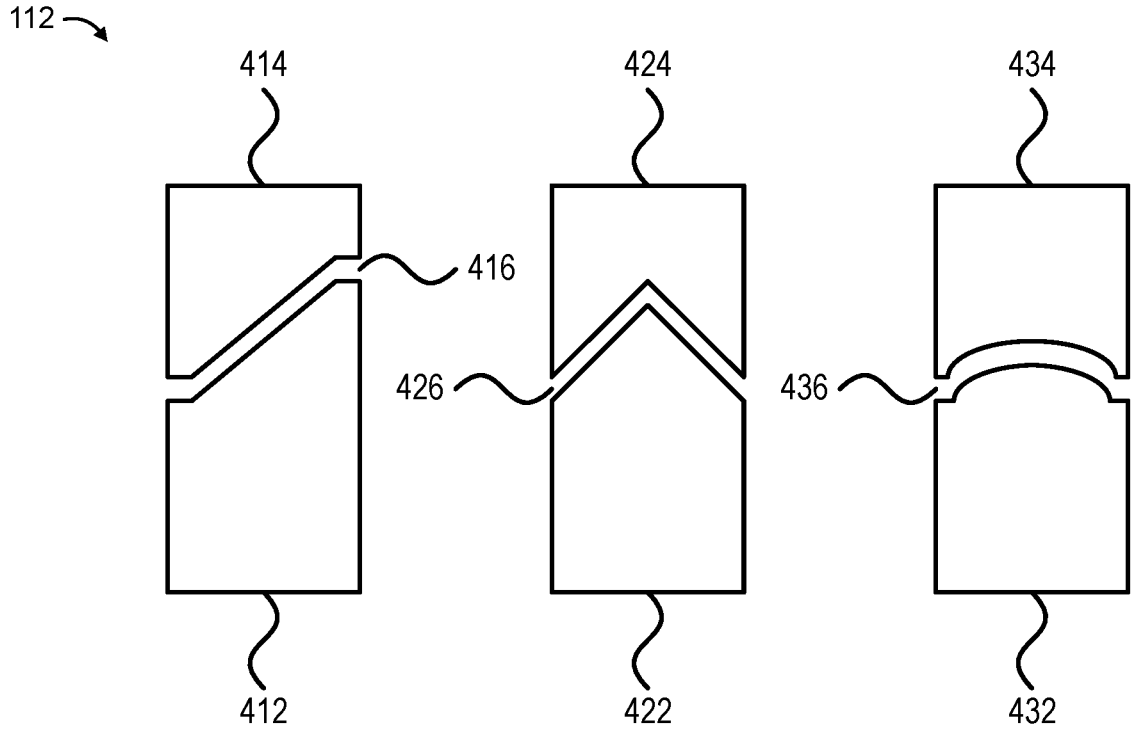
FIG. 4 is a diagram showing different embodiments of an interface between a lid and a body of a storage container embodying features consistent with the principles of the present disclosure.
Figure 5:
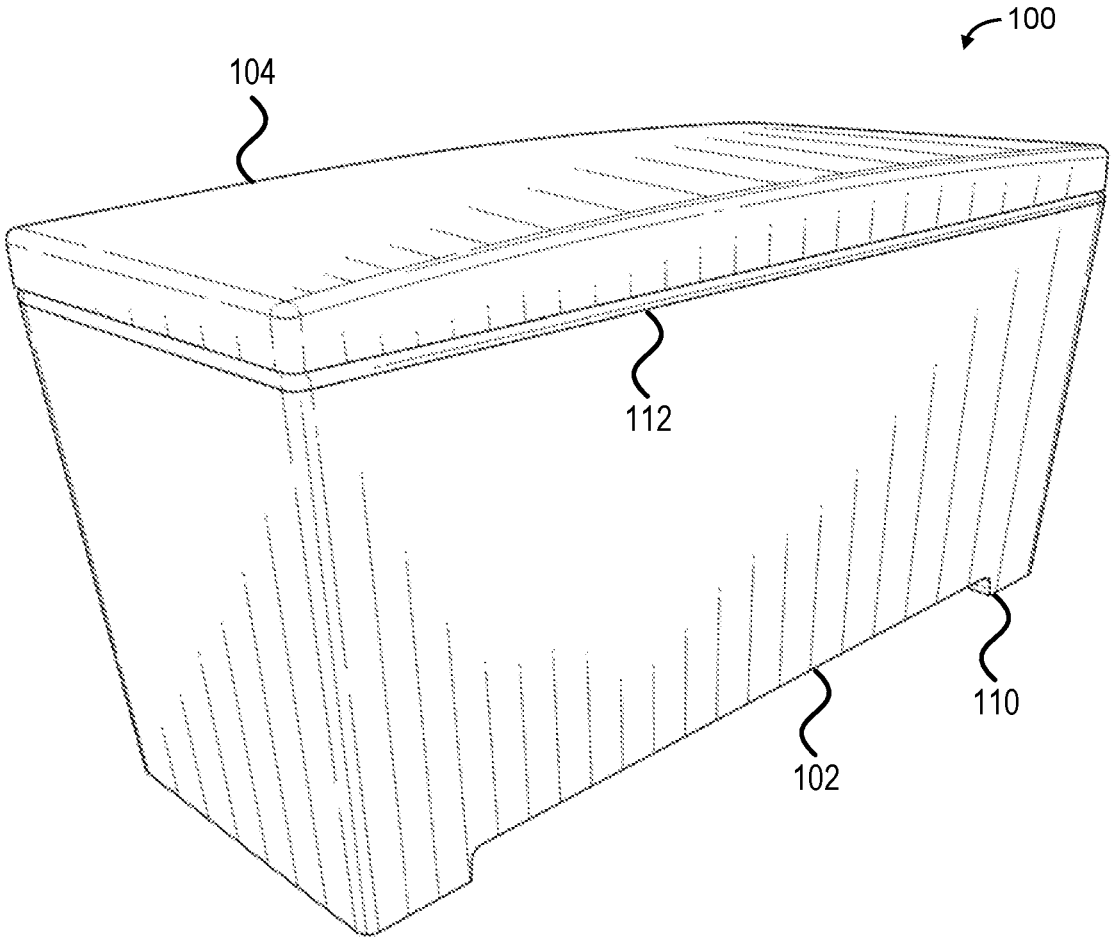
FIG. 5 is a diagram showing a perspective view of a secure, self-powered, climate-controlled storage container embodying features consistent with the principles of the present disclosure.
Figure 6:
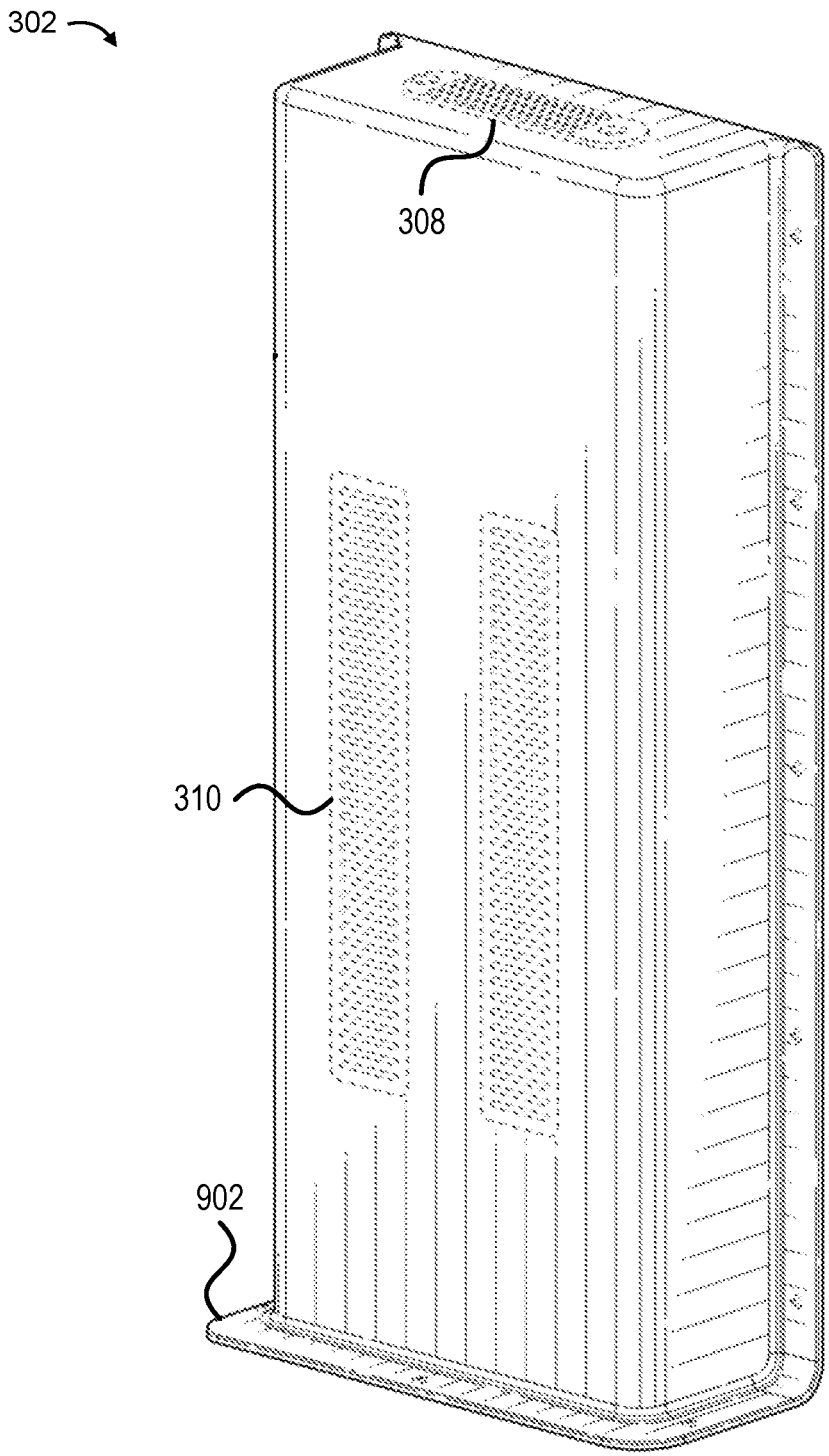
FIG. 6 is a diagram showing a perspective view of a climate control conduit embodying features consistent with the principles of the present disclosure.

FIGS. 1-6 illustrate embodiments of a system 100 designed for controlling humidity in high humidity environments, such as a boat dock. FIG. 1 depicts a preferred embodiment of a system 100 designed to control humidity in high humidity environments. FIG. 2 illustrates a cut-away view of the lid 104 of the system 100, illustrating components contained within said lid 104. FIG. 3 illustrates a cut-away view of the body 102 of the system 100, illustrating a portion of the interior. FIG. 4 illustrates different mating configurations that may be used to mate the edges 112 of the body and the lid 104. FIG. 5 illustrates a perspective view of a system 100 having curvilinear cosmetic features. FIG. 6 is a more detailed illustration of the conduit within the interior of the system 100.

As illustrated in FIG. 1, the system 100 generally comprises a body 102, lid 104, and power supply 106, 108, wherein an edge 112 of the body 102 securely mates with an edge 112 of the lid 104. A power supply 106, 108 may provide electrical power to the components that are positioned within the body 102 and/or top 104 of the system 100. In some preferred embodiments, the body 102 may further comprise feet 110. The feet 110 may be seamlessly incorporated into the bottom of the body 102 or may be separate structures that are connected to the bottom surface of the body 102. The feet 110 provide air circulation underneath the system 100, which may help to prevent mold from forming at the base of the system 100. Additionally, water generated by a dehumidifier 306 of the body 102 of the system 100 may exit the system 100 via a drainage hole of the body 102, and the feet 110 may raise the body 102 to allow for proper drainage.

The electrical components of the system 100 are powered by the power supply 122. The power supply 122 may be any source of power that provides the system 100 with electricity. In one preferred embodiment, the system 100 may comprise of multiple power supplies 122 that may provide power to the system 100 in different circumstances. For instance, the system 100 may be directly plugged into a stationary power source at the power interface 108, which may provide power to the system 100 so long as it remains in one place. In a preferred embodiment, the stationary power source may be a stationary power outlet. However, the system 100 may also be connected to a mobile power source so that the system 100 may receive power even when it is not receiving power from a stationary power source.

In a preferred embodiment, the lid 104 may include a solar panel 106 on its top surface, which may provide electrical power to the system 100. The lid 104 may include a recessed portion, to accommodate the thickness of the solar panel 106, allowing the solar panel 106 to be flush with the surface of the lid 104. The material of the system 100 may include, for example, reinforced plastic or fiber glass. The surfaces may be reinforced with, for example, wood or metal supports that add rigidity to the surface. In other preferred embodiment, the system 100 may be capable of using multiple types of power supplies 122. For instance, as illustrated in FIG. 1, the system 100 may comprise a mobile power source and a stationary power source in the form of a solar panel 106 and power interface 108, which may allow the system 100 to receive power regardless of the situation in which it is being used. For instance, the system 100 may use the mobile power source when a marine vehicle in which it is installed is on the water and may use a stationary power source when the marine vehicle in which it is installed is hooked up to a stationary power outlet at a marina.

The lid 104 and body 102 may contact each other at a lid edge 202 and body edge 301, respectively. As illustrate in FIG. 4, these edges 112 may include mating surfaces, configured to provide a secure seal along the perimeter of the system 100. The mating surfaces may further be configured to provide a tight seal between the lid 104 and body 102, making it difficult to force the lid 104 open with the use of a pry bar. While it is contemplated that a lock may be used to secure the lid 104 to the body 102, in some preferred embodiments, an automatic opening/closing mechanism may render a lock superfluous. In other preferred embodiments, the system 100 may itself be bolted to an underlying surface, such as a dock or deck, through a hole in the base of the body 102 or via feet 110, which may prevent the system 100 itself from being stolen.

The lid 104 may include a hinge 230 and structural features to ensure a repeatable, effortless seal. As illustrated in FIG. 4, different mating configurations of the body edge 301 and lid edge 202. In a first configuration, a first body edge 412 and first lid edge 414 have complementary sloped surfaces, forming a sloped interface 416. It is specifically contemplated that the low point of the slope may be positioned towards the exterior of the body 102 whereas the high point of the slope may be positioned towards the interior of the body 102. This configuration may inhibit water from infiltrating the system 100 via the ridge, for example due to spray from boats or waves, rain, and wind. In a second configuration, a second body edge 422 and second lid edge 424 have complementary triangular surfaces, forming a triangular interface 426. This configuration may inhibit water from infiltrating the system 100 via the ridge while adding structural support when the lid 104 is in a closed position; though the water inhibition properties might not be as great as the sloped interface, making this configuration better for piers/docks. For instance, as illustrated in FIG. 4, the body's edge 422 comprises a triangular portion that extends upward into a triangular space of the lid's edge 424.

In a third configuration, a third body edge 432 and third lid edge 434 may have complementary curved surfaces, forming a concave interface. This configuration may be particularly useful for preventing theft by limiting the amount of space for a crowbar to wedge between the body 102 and the lid 104. For instance, as illustrated in FIG. 4, the body's edge 432 may have a convex surface that extends upward into a concave space of the lid's edge 434. Although these three interface configurations are specifically contemplated, a person with skill in the art will understand that any complementary shape may be used to help guide the lid 104 as it is lowered onto place, thereby decreasing the likelihood that the lid 104 will close incompletely or leave gaps. Any of these configurations may furthermore include weather stripping or some other form of seal to further inhibit the infiltration of water and humid air.

As illustrated in FIG. 2, an interior space of the lid 104, represented by a cut-away 204 signified by a dashed line, contains a charging interface 210, charging controller 212, battery 214, actuator controller 216, light controller 218, dehumidifier controller 228 and electrical circuitry connecting the various electronic components. Although these components are specifically contemplated and shown as being placed within the lid 104, it should be understood that they may be placed in any appropriate space or spaces within the system 100. For example, the air intake fans 206 may be positioned in a sidewall of the body 102, with the appropriate control and power devices similarly being formed in a cavity or separate container within the body 102.

In embodiments comprising a solar panel, the solar panel 106 may be connected to the interior space via the charging interface 210. The charging interface 210 may include connection points for the solar panel 106, positioned at the back of the solar panel 106 and penetrating the top surface of the lid 104. This charging interface 210 may, in turn, be connected to the charging controller 212, which may regulate charge and prevent battery overcharge and drainage, and then to battery 214. The battery 214 may also, or alternatively, be powered by a stationary power source via the power interface 108, as illustrated in FIG. 1. It is specifically contemplated that the battery 214 may be a high-capacity lithium-ion battery, but one with skill in the art will understand that other battery technology may be used without departing from the inventive subject matter described herein.

The actuator controller 216 powers actuators of the system 100 that lift and shut the lid 104. The actuator controller 216 may trigger the raising and lowering of the lid 104 in accordance with a computer readable signal received by said actuator controller from a wired/wireless interface. In a preferred embodiment, the wired/wireless interface is a wireless remote control or fob configured to send a computer readable signal to a communication device, such as an antenna, of the actuator interface. Thus, a user holding said wireless remote control or fob can trigger the actuator controller 216 from anywhere within wireless range. Alternatively, or in addition, the wired/wireless interface may be a wired controller comprising a switch. For instance, wired controller secured to the exterior of the system 100 may be used to open and close the lid 104 via manipulation of the switch. In some preferred embodiments, the wired/wireless interface may include security measures, such as a keypad for the entry of an identification code, a biometric scanner for scanning fingerprints, or a physical key, which may ensure that only an authorized user will have access to the interior of the system 100.

The light controllers 218, 224 control the various lighting 316 of the system 100. The interior light controller 218 controls the lighting 316 of the lid 104 and/or within the cavity of the body 102 whereas the exterior light controller 224 controls the intensity of exterior lighting 316 of the system 100. These light controllers 218, 224 may turn lighting 316 on or off, by dim or brighten lighting 316, and/or control coloring of the lighting 316. For instance, the system 100 may cause the lighting 316 to emit a strong red light in a way that helps a fisherman see without crippling their night vision. Lighting 316 within the cavity is preferably turned on by the system 100 when the lid 104 is opened. This may be accomplished by way of a switch that closes when the lid 104 is in an open position. Although shown as a set of individual lights, in FIG. 3, it should be understood that lighting 316 may be in any configuration without departing from the invective subject matter described herein. For example, small lights may be arranged in a row along the corners of the cavity of the body 102 or in a design about the exterior surface of the body 102. The lighting 316 may be any appropriate light source, such as incandescent light, fluorescent lights, electroluminescent lights, and/or LEDs.

In some preferred embodiments, sensors may be used to help the light controllers to make decisions on how to manage lighting 316 of the system 100. For instance, a tilt sensor of the lid 104 may be used to collect orientation data so that the system 100 may determine the position of the lid 104 and turn on lighting 316 (such as light emitting diodes (LEDs)) within the lid 104 or body 102 based on the position. In some preferred embodiments, sensors may be used to collect light data so that the system may determine the amount of ambient light (or other environmental factors) within the surrounding environment and adjust the amount of light the exterior lighting 316 produces. Therefore, the interior light controller 218 and exterior light controller 224 may adjust the lighting 316 of the system 100 to best fit the needs of a user at a given time depending on whether the system 100 is currently being used and environmental factors affecting the user and system 100.

The dehumidifier interface 226 may control the operation of the dehumidifier 306 contained within the cavity of the body 102. These interfaces may be implemented as any appropriate device, such as a button, switch, dial, toggle, or any assortment of devices. The dehumidifier controller 228 provides power to the dehumidifier 306 in the system 100 and may further include sensors to measure the internal humidity. Thus, in some preferred embodiments, the system 100 may include a humidistat and/or hygrometer. Intake fans 206 draw air from the cavity of the body 102 and into an internal channel of the lid 104, wherein the internal channel is configured to guide air from the intake fans 206 to an air outlet 208. The air outlet 208 is configured to mate with the air inlet 308 of the conduit 302 when the lid 104 is in a closed position.

In a preferred embodiment, the control panel 221 of the lid 104 includes manual controls that may be used to control various operations of the system 100. In some preferred embodiments, an emergency release interface 222 may be used to trigger the actuator controller 216 to lift the lid 104, providing a person trapped within the system 100 the ability to cause the system 100 to raise the lid 104 so that they might exit. In other preferred embodiments, a display of the control panel may display a user interface, which a user may manipulate to control the various features of the system 100. For instance, a user may control light settings, humidity settings, etc. via the control panel. Therefore, some embodiments of the system 100 may comprise a control panel that acts as the controls for the various components of the system 100.

As illustrated in FIGS. 2-3, leads from the actuator controller 216 and the interior light controller 218, and power for the dehumidifier, may exit the interior space of the lid 104 via a lid port 220, which leads to an interior port 312 of the body 102. The interior port 312 of the body 102 allows passage of electrical and control leads from the lid port 220. The interior port 312 may lead into the conduit 302 or into an interior space of the sidewalls of the body 102. Although not shown in detail, one with skill in the art will understand that control and power leads from the lid 104 connect to the relevant components in the body 102.

The lid 104 may connect to the body 102 via a hinge 230, which is preferable located on the body 102 in the position depicted in FIG. 3. In some cases, the hinge 230 may be a metal device, with respective plates fastened to the lid 104 and the body 102, and with a pin rotatably connecting the plates to one another. In other cases, the hinge 230 may simply be a strip of strong material, such as a synthetic fiber, such as carbon fiber strips, glued to the respective edges 112 of the lid 104 and the body 102, that are connected by a synthetic fiber joint. Because the lid 104 may be held in place by the actuators, and because the lid edge 202 may be configured to mate securely with the body edge 301, there may be no need for a rigid hinge.

A conduit 302 having an air inlet 308 mates with the air outlet 208 of the lid 104. Air moves from the lid 104, into the conduit 302, via the air outlet 208 and the air inlet 308. The interior of the conduit 302, as shown by a cut-away 304 signified by a dashed line, comprises a dehumidifier 306, which operates to extract moisture from the air that passes through the conduit 302. The dehumidified air exits the conduit 302 by way of vents 310. As illustrated in FIG. 6, the conduit 302 may include a flanged edge 902. This flanged edge 902 may be tightly fastened to the sidewall and bottom surface of the body 102 to provide a degree of airtightness, which may facilitate the proper air flow from the air inlet 308 to the dehumidifier 306 to the vents 310.

Due to the operation of the intake fans 206 in the lid 104, air may circulate through the system 100 until the humidity level of the air has dropped below a specified threshold. Once the humidity level has reached said threshold, the intake fans 206 may reduce speed, or stop entirely, and the dehumidifier 306 may shut off until it is determined that the humidity level has once again risen above the threshold. In a preferred embodiment, the dehumidifier 306 may operate by a Peltier process, but it should be understood that any appropriate dehumidification mechanism may be used without departing from the inventive subject matter described herein. In some cases, moisture that collects at the dehumidifier 306 may drip down to the bottom of the system 100 and may exit the system 100 via one or more drainage holes. In other preferred embodiments, moisture may be actively removed from the system 100, for example using a pump.

As illustrated in FIG. 3, the actuators 314 are located within the cavity of the body 102. The actuators 314 are preferably connected to attachment points on the lid 104, allowing the actuators to move the lid 104 into and open position and closed position when triggered to extend or contract. In a preferred embodiment, a computer readable signal causes the actuator arms to extend and press upward or contract and pull downward, against a surface of the lid 104, thereby pushing the lid 104 upward or downward. Because the lid 104 may be anchored along one edge 112 by the hinge 230, the lid 104 may open at an angle. In some cases, the actuators 314 may hold their positions with a large amount of force to keep the lid 104 securely in place when in an open position and/or closed position. In one preferred embodiment, each actuator 314 may be able to exert 1500 lbs of force, resulting in a total of 3000 lbs of force that can be used to lift the lid 104 or hold it in place. The actuators 314 may further be configured to detect when unexpected resistance is present during opening or closing, and may automatically halt, to prevent injury.

The cavity of the body 102 may further be configured according to a user's needs. Attachment points may be provided on the interior surface, where any appropriate accessory may be mounted. For example, such accessories may include shelves, boxes, and other storage subdivisions. Electrical outlets may also be provided, to allow charging of devices within the system 100, such as radios, flashlights, mobile computing devices, and other personal electrical or electronic devices. In some cases, cold storage may be provided, with the inclusion of a refrigeration unit, which may take up part or all the body 102. Further, as illustrated in FIG. 5, the lid 104 need not be perfectly rectilinear and instead include a curved surface. The curve may improve the aesthetic appearance of the system 100 but may also provide additional interior space.

In some preferred embodiments, as illustrated in FIG. 5, the feet 110 may be integrated with the base of the body 102. The edge 112 between the lid 104 and the body 102 is also shown, with the sloped surface of the body edge 301 being depicted. Additionally, the body 102 is shown with a profile that is larger at the top, and that tapers toward the base. It should be understood that the shape and proportions of the system 100 are not limited to the embodiments described herein and may be adapted to any situation.

The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flow depicted in the accompanying figures and/or described herein do not necessarily require the particular order shown, or sequential order, to achieve desirable results. It will be readily understood to those skilled in the art that various other changes in the details, materials, and arrangements of the parts and method stages which have been described and illustrated in order to explain the nature of this inventive subject matter can be made without departing from the principles and scope of the inventive subject matter.

What is claimed is:

1. A system for managing humidity level in high humidity environments comprising:

a body having a cavity, wherein a conduit within said cavity contains a dehumidifier configured to remove humidity from air within said cavity, wherein said conduit extends from a bottom of said cavity to a top of said cavity, wherein an air inlet of said conduit located above said dehumidifier is configured to accept humidified air, wherein a vent of said conduit located below said dehumidifier is configured to allow dehumidified air to enter said cavity, a lid rotatably attached to a body edge of said body, wherein at last one intake fan is configured to move humidified air from said cavity of said body to an internal channel of said lid, wherein an air outlet of said lid in direct communication with said air inlet of said conduit is configured to pass humidified air from said internal channel to said conduit, an actuator secured to an interior wall of said body and an attachment point of said lid, wherein said actuator is configured to place said lid in an open position when an arm of said actuator extends, wherein said actuator is configured to place said lid in a closed position when said arm of said actuator retracts, actuator control circuitry configured to cause said arm of said actuator to extend and retract in response to a computer readable signal, and a power supply configured to provide electrical power to said dehumidifier, actuator, actuator control circuitry, and at least one intake fan.

2. The system of claim 1, wherein said power supply comprises a solar cell and a battery, wherein said solar cell is located on a top surface of said lid, and wherein said battery is located within an interior space of said lid and charged by said solar cell, and wherein said battery is configured to provide power to said dehumidifier, actuator, actuator control circuitry, and intake fan.

3. The system of claim 1, further comprising lighting located on said interior wall of said body.

4. The system of claim 3, further comprising a control panel operably connected to said dehumidifier and said lighting, wherein said control panel allows a user to manipulate various settings of said dehumidifier and said lighting, wherein at least one of humidity threshold, lighting intensity, lighting color, and lighting threshold may be manipulated using said control panel.

5. A system for managing humidity level in high humidity environments comprising:

a body having a cavity, wherein a conduit secured to a wall of said body within said cavity contains a dehumidifier configured to remove humidity from air within said cavity, wherein said conduit extends from a bottom of said cavity to a top of said cavity and has an internal space configured to allow for a flow of humidified air to said dehumidifier and a flow of dehumidified air from said dehumidifier, wherein an air inlet at a top end of said conduit is configured to accept humidified air from an air outlet, wherein vents at a bottom end of said conduit are configured to allow dehumidified air to enter said cavity, a lid rotatably attached to a body edge of said body on one side via a hinge, wherein at last one intake fan located on a bottom side of said lid is configured to move humidified air from said cavity of said body to an internal channel of said lid, wherein said internal channel ends at said air outlet of said lid, wherein said air outlet of said lid is in direct communication with said air inlet of said conduit and is configured to pass humidified air from said internal channel to said conduit, wherein said lid has a lid edge configured to interlock with a body edge of said body, an actuator secured to an interior wall of said body and an attachment point of said lid, wherein an arm of said actuator is configured to extend and retract in a way that causes said lid to rotate about said hinge, actuator control circuitry configured to cause said arm of said actuator to extend and retract in response to a computer readable signal, and a power supply configured to provide electrical power to said dehumidifier, actuator, actuator control circuitry, and at least one intake fan.

6. The system of claim 5, wherein said power supply comprises a solar cell and a battery, wherein said solar cell is located on a top surface of said lid, and wherein said battery is located within an interior space of said lid and charged by said solar cell, and wherein said battery is configured to provide power to said dehumidifier, actuator, actuator control circuitry, and intake fan.

7. The system of claim 5, further comprising lighting located on said interior wall of said body.

8. The system of claim 7, further comprising a control panel operably connected to said dehumidifier and said lighting, wherein said control panel allows a user to manipulate various settings of said dehumidifier and said lighting, wherein at least one of humidity threshold, lighting intensity, lighting color, and lighting threshold may be manipulated using said control panel.

9. A system for managing humidity level in high humidity environments comprising:

a body having a cavity, wherein a conduit secured to a wall of said body within said cavity contains a dehumidifier configured to remove humidity from air within said cavity, wherein said conduit extends from a bottom of said cavity to a top of said cavity and has an internal space configured to allow for a flow of humidified air from an air inlet to said dehumidifier and a flow of dehumidified air from said dehumidifier to a vent, a lid rotatably attached to a body edge of said body on one side via a hinge, wherein at least one intake fan located on a bottom side of said lid is configured to move humidified air from said cavity of said body to an internal channel of said lid, wherein said internal channel extends through said cavity from said at least one intake fan to an air outlet in direct communication with said air inlet of said conduit, wherein a lid edge of said lid is configured to interlock with said body edge of said body to create a seal, wherein said lid edge and said body edge are both sloped to form a sloped interface, wherein said sloped interface has a low point located towards an exterior of said body and a high point located towards an interior of said body, an actuator secured to an interior wall of said body and an attachment point of said lid, wherein an arm of said actuator is configured to extend and retract in a way that causes said lid to rotate about said hinge, actuator control circuitry configured to cause said arm of said actuator to extend and retract in response to a computer readable signal, and a power supply configured to provide electrical power to said dehumidifier, actuator, actuator control circuitry, and at least one intake fan.

10. The system of claim 9, further comprising weather stripping about at least one of said lid edge and said body edge, wherein said weather stripping increases an effectiveness of said seal to repel water.

* * * * *